United States Patent [19]

Kemmner

[11] 4,449,891

[45] May 22, 1984

[54] AGGREGATE FOR SUPPLYING FUEL FROM SUPPLY CONTAINER TO INTERNAL COMBUSTION ENGINE

[75] Inventor: Ulrich Kemmner, Stuttgart, Fed. Rep. of Germany

[73] Assignee: Robert Bosch GmbH, Stuttgart, Fed. Rep. of Germany

[21] Appl. No.: 356,157

[22] Filed: Mar. 8, 1982

[30] Foreign Application Priority Data

Jun. 13, 1981 [DE] Fed. Rep. of Germany ..... 3123579

[51] Int. Cl.[3] ..... F04D 29/04

[52] U.S. Cl. ..... 417/423 R; 415/53 T; 415/213 T; 415/170 R

[58] Field of Search ..... 415/53 T, 142, 111, 415/170 R, 213 T, 198.2, 121; 384/276, 280; 417/423 R

[56] References Cited

U.S. PATENT DOCUMENTS

| | | | |
|---|---|---|---|
| 3,405,644 | 10/1968 | Skinner | 415/213 T |
| 3,771,898 | 11/1973 | Segebrecht | 415/213 T |
| 3,836,291 | 9/1974 | Bottcher et al. | 415/53 T |
| 4,231,718 | 11/1980 | Ruhl et al. | 415/53 T |

FOREIGN PATENT DOCUMENTS

| | | | |
|---|---|---|---|
| 874503 | 4/1953 | Fed. Rep. of Germany | 415/213 T |

*Primary Examiner*—Stephen Marcus
*Assistant Examiner*—John Kwon
*Attorney, Agent, or Firm*—Michael J. Striker

[57] ABSTRACT

An aggregate for supplying a fuel from a supply container to an internal combustion engine has a driven shaft with an axis, a pump chamber with a wall transverse to the axis of the shaft, an impeller driven by the shaft in the pump chamber, and supporting formations for supporting the impeller and having a central recess in the impeller and a bearing projection on the wall of the pump chamber and extending into the recess of the impeller.

16 Claims, 2 Drawing Figures

AGGREGATE FOR SUPPLYING FUEL FROM SUPPLY CONTAINER TO INTERNAL COMBUSTION ENGINE

BACKGROUND OF THE INVENTION

The present invention relates to aggregate for supplying a fuel from a supply container to an internal combustion engine.

A supply aggregate of the above-mentioned general type is known in the art. A driven shaft in this aggregate extends into a pump chamber, and an impeller is fixedly mounted on the shaft. In this construction it is necessary to satisfy high requirements relative to support of the impeller even with the support of the shaft, which considerably exceed the requirements with regard to the general support of the shaft.

SUMMARY OF THE INVENTION

Accordingly, it is an object of the present invention to provide an aggregate for supplying a fuel from a supply container to an internal combustion engine, which avoids the disadvantages of the prior art.

More particularly, it is an object of the present invention to provide an aggregate for supplying a fuel from a supply container to an internal combustion engine, in which a driven shaft acts only as a drive element on the impeller and does not carry out bearing functions for the impeller.

In keeping with these objects and with others which will become apparent hereinafter, one feature of the present invention resides, briefly stated, in an aggregate for supplying a fuel from a supply container to an internal combustion engine in which an impeller is provided with a central recess, and a pump chamber extending transverse to the axis of a driven shaft is provided with a projection extending into the recess of the impeller.

When the aggregate is designed in accordance with the present invention, it eliminates the disadvantages of the prior art.

The bearing projection may be formed on the wall of one piece with the same, and the wall together with the projection may be manufactured by a non-cutting method and composed of synthetic plastic material.

On the other hand, the bearing projection may be formed as a separate member connected with the wall of the pump chamber and formed of a material which is swell-free relative to the fuel.

The central recess of the impeller may be formed as a blind hole with a gap which is smaller than the length of the projection of the wall. The end face of the projection of the wall may have a spherical shape. The base face of the blind hole may be formed by a preferably metallic disc arranged in the blind hole. A bearing bush may coat the central recess of the impeller.

Another feature of the invention is that the shaft may extend through another wall which is located opposite to the first-mentioned wall with the projection. The shaft may be connected with the impeller in interengaging manner.

Still another feature of the present invention is that a pump including the impeller and the pump chamber may be formed as a two-stage periphery pump.

Finally, a further feature of the present invention is that the aggregate may include an electric motor having an armature shaft formed by the driven shaft, at least one further wall forming together with the first-mentioned wall the pump chamber, and a tubular housing surrounding the electric motor and the wall of the pump chamber. The end regions of the housing may be provided with claw-like formations for holding the part of the aggregate.

The novel features which are considered as characteristic for the present invention are set forth in particular in the appended claims. The invention itself, however, both as to its construction and its method of operation, together with additional objects and advantages thereof, will be best understood from the following description of specific embodiments when read in connection with the accompanying drawing.

DESCRIPTION OF PREFERRED EMBODIMENTS

Figure 1:
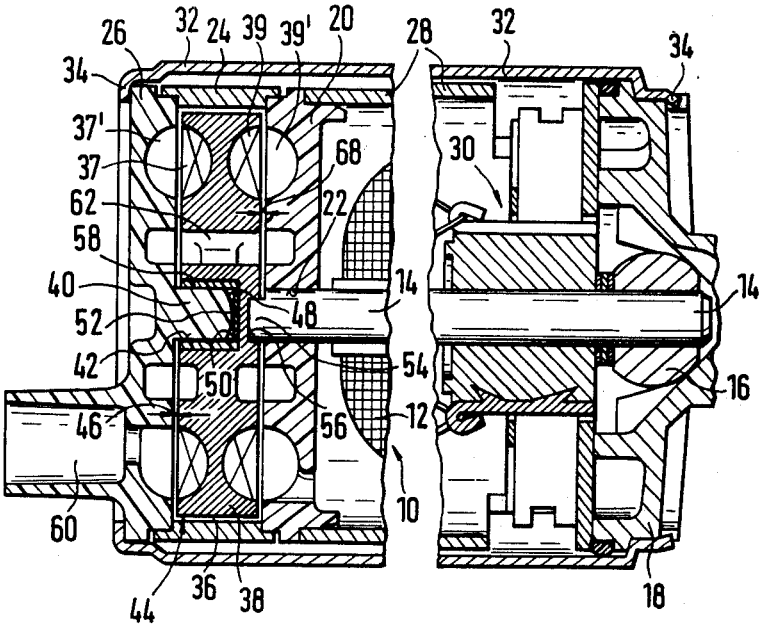
FIG. 1 is a view showing a section for supplying a fuel from a supply container to an internal combustion engine in accordance with the present invention.

An aggregate for supplying a fuel in accordance with the present invention has an electric motor 10 with an armature 12 arranged on an armature shaft 14.

The armature shaft 15 is supported at its one end in a cup-shaped bearing 16 which is arranged in a bearing shield 18 to be centered. The other end of the armature shaft 14 is supported in an intermediate wall 20 whose central opening 22 serves as a sliding bearing for the armature shaft 14. An annular wall 24 abuts against the intermediate wall 20, and more particularly against its side facing away from the electric motor 10. The annular wall 24 has a side facing away from the intermediate wall and provided with a suction plate 26.

The electric motor is surrounded by a locking ring 28 which extends between the intermediate wall 20 and a commutation device 30 of the motor 10. The entire construction is arranged in a tubular housing 32 with end regions provided with dislocated or flanged claws 34. The end regions may also be formed as border edges. The thus-formed end regions assemble the individual elements 18, 20, 24, 26, 28 and 30 with one another.

The annular wall 24 forms a spacer ring against which the intermediate wall 20 and the suction plate 26 abut. A pump chamber 36 is thereby formed and an impeller 38 is arranged in the pump chamber 36. The support of the impeller 38 in the pump chamber 36 is carried out by a bearing projection 40 which extends from the suction plate 26 into a central rccess 42 of the impeller 38. In the embodiment of FIG. 1 the suction plate 26 is composed of synthetic plastic material, and the bearing projection 40 is directly formed on the suction plate 26 of one piece therewith.

The central recess 42 in the impeller 38 is formed as a blind hole with a depth which is smaller than the length of the bearing projection. This construction provides an axial gap 46 between the impeller 38 and the suction plate 26, the gap being important for the operation of the pump 44. An end face 48 of the bearing projection 40 has a spherical shape, and a base face 50 of the blind hole 42 is formed by a metallic disc arranged in the same. This construction provides for the following advantages:

Because of the respective determination of the thickness of the metal disc, manufacturing tolerances can be compensated, so that the axial gap 46 can be optimized without difficulties. Because of the spherical construction of the end face 48 of the bearing projection 40, a substantially point-shaped contact location of the metallic disc 52 on the bearing projection 40 takes place, so that the friction in this region is reduced to a minimum. Furthermore, because of the determination of the sliding pair, the bearing projection 40 on the one hand and the metallic disc 52 on the other hand, a further reduction of the small friction is attained and the wear condition is optimized.

As can be further seen from FIG. 1, the armature shaft 14 extends through the intermediate wall 20 with an end region 54 which is inserted in a depression 56 which is opposite to the central recess 42 of the impeller 38. The end portion 54 and the depression 56 are so determined relative to one another that they provide an interengaging connection between the end portion 54 and the depression 56 which does not apply lateral or tilting forces upon the impeller. The rotary transmission can be performed by a suitable coupling piece between the impeller 38 and the armature shaft 14. FIG. 1 further shows that the central recess 42 of the impeller 38 is coated with a bearing bush 58. The latter is also composed of the material which is a suitable sliding material relative to the material of the bearing projection 40.

During the operation, that is when the electric motor 10 is driven, the motor armature 12 and the armature shaft 14 together with the latter rotate so that the end portion 54 of the armature shaft 14 drives the impeller 38 in the pump chamber 36. A fuel to be supplied is aspirated through a suction opening 60 in the suction plate 26 into the pump chamber 36. From the pump chamber 36 the fuel flows through a first pump stage including a vane rim 37 and a lateral passage 37' with a pressure increase into a passage 62 in the impeller 38, and from there into a second pump stage including vane rim 39 and a lateral passage 39' where the pressure is further increased. The fuel leaves the pump chamber through an outlet opening in the intermediate wall 20, flows through the electric motor 10 until it leaves the aggregate through a non-shown outlet pipe on the bearing shield 18. Since the supply pressure in the second pump stage is greater than in the first pump stage, the impeller 38 is pressed to the suction plate so that in operation of the aggregate the base face 50 of the central recess 42 abuts against the spherical end face 48 of the bearing projection 40. By respective determination of the width of the chamber and the of the impeller, a predetermined second axial gap 46 is formed between the intermediate wall 20 and the impeller end face facing towards the latter. Thereby a simple construction of a two-stage peripheral pump is provided.

Figure 2:
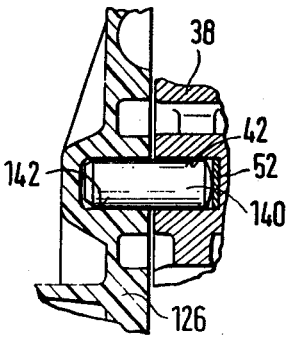
FIG. 2 is a view showing a fragment of the inventive aggregate in accordance with another embodiment of the present invention.

The aggregate shown in FIG. 2 has a bearing projection 140 which is formed as a separate member. The bearing projection 140 is composed of the material which is swell-free relative to the fuel and mounted in a bore 142 of the suction plate 126. In consideration of specific properties of the different fuel, the bearing projection 140 can be composed, for example, of metal, carbon, etc. Mounting of the bearing projection 140 in the receiving recess 142 can be performed by pressing in, injection or sound treatment.

It will be understood that each of the elements described above, or two or more together, may also find a useful application in other types of constructions differing from the types described above.

While the invention has been illustrated and described as embodied in an aggregate for supplying a fuel from a supply container to an internal combustion engine, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of the present invention.

What is claimed as new and desired to be protected by Letters Patent is set forth in the appended claims:

1. An aggregate for supplying a fuel from a supply container to an internal combustion engine, comprising a driven shaft having an axis; means forming a pump chamber and including a wall transverse to said axis of said shaft; an impeller driven by said shaft in said pump chamber; and means for supporting said impeller and having a central recess provided in said impeller, and a bearing projection provided on said wall of said pump chamber and extending into said recess of said impeller.

2. An aggregate as defined in claim 1, wherein said bearing projection is formed on said wall of one-piece with the latter.

3. An aggregate as defined in claim 1, wherein said wall of said pump chamber is a non-cutting method produced wall.

4. An aggregate as defined in claim 1, wherein said wall of said pump chamber is composed of a synthetic plastic material.

5. An aggregate as defined in claim 1, wherein said bearing projection is formed as a separate member connected with said wall of said pump chamber.

6. An aggregate as defined in claim 5, wherein said projection is formed of a material which is swell-free relative to the fuel.

7. An aggregate as defined in claim 1, wherein said projection of said wall has a predetermined length, said central recess of said impeller being formed as a blind hole with a depth which is smaller than the length of said projection of said wall.

8. An aggregate as defined in claim 1, wherein said projection of said wall has an end face which has a spherical shape.

9. An aggregate as defined in claim 7, wherein said blind hole has a base face formed by a disc arranged in said blind hole.

10. An aggregate as defined in claim 9, wherein said disc which forms said base face is composed of metal.

11. An aggregate as defined in claim 1; and further comprising a bearing bush which coats said central recess of said impeller.

12. An aggregate as defined in claim 1; and further comprising another wall located opposite to said first-mentioned wall with said projection, said shaft extending through said other wall.

13. An aggregate as defined in claim 1, wherein said shaft is arranged so that it is connected with said impeller in interengaging manner.

14. An aggregate as defined in claim 1, wherein said impeller and said pump chamber are parts of a pump which is formed as a two-stage periphery pump.

15. An aggregate as defined in claim 1; and further comprising an electric motor having an armature shaft formed by said driven shaft, at least one further wall forming together with said first-mentioned wall said pump chamber, and a tubular housing surrounding said electric motor with said walls of said pump chamber.

16. An aggregate as defined in claim 15, wherein said housing has end regions provided with claw-like formations for holding parts of the aggregate.

* * * * *